US006755059B1

(12) United States Patent
Nall

(10) Patent No.: US 6,755,059 B1
(45) Date of Patent: Jun. 29, 2004

(54) COMBINATION LOCK

(76) Inventor: Kent J. Nall, 23208 NE. 164th St., Kearney, MO (US) 64060

( * ) Notice: Subject to any disclaimer, the term of this patent is extended or adjusted under 35 U.S.C. 154(b) by 0 days.

(21) Appl. No.: 10/325,130

(22) Filed: Dec. 20, 2002

(51) Int. Cl.[7] ..... E05B 37/16

(52) U.S. Cl. ..... 70/298; 70/312; 70/25; 292/DIG. 37

(58) Field of Search ..... 70/298, 25, 22, 70/312, 299; 292/DIG. 37

(56) References Cited

U.S. PATENT DOCUMENTS

| | | | | | |
|---|---|---|---|---|---|
| 1,686,632 | A | * | 10/1928 | Mayer | 70/25 |
| 2,497,619 | A | * | 2/1950 | Mass | 70/25 |
| 2,549,882 | A | * | 4/1951 | Berger | 70/288 |
| 2,590,516 | A | | 3/1952 | Von Breymann | |
| 2,664,658 | A | | 1/1954 | Bjorklund | |
| 3,386,271 | A | * | 6/1968 | Morin | 70/25 |
| 3,388,572 | A | * | 6/1968 | Morin | 70/315 |
| 4,084,341 | A | | 4/1978 | Cervantes | |
| 4,476,698 | A | * | 10/1984 | Treslo | 70/25 |
| 4,509,281 | A | | 4/1985 | Dreiling et al. | |
| 4,602,491 | A | | 7/1986 | Mauer | |
| 4,627,250 | A | | 12/1986 | Kim | |
| 4,660,394 | A | * | 4/1987 | Wu | 70/25 |
| 4,748,833 | A | | 6/1988 | Nagasawa | |
| 4,751,830 | A | * | 6/1988 | Cheng | 70/25 |
| 4,866,958 | A | | 9/1989 | Bretl et al. | |
| 4,959,978 | A | | 10/1990 | Cappell et al. | |
| 5,335,521 | A | * | 8/1994 | Brooks | 70/298 |
| 5,582,049 | A | | 12/1996 | Mauer | |
| 6,029,481 | A | * | 2/2000 | Lai | 70/25 |
| 6,125,568 | A | | 10/2000 | Granaroli | |

* cited by examiner

*Primary Examiner*—John B. Walsh
(74) *Attorney, Agent, or Firm*—Chase Law Firm, L.C.

(57) ABSTRACT

A combination lock and locking pin is provided which includes indexed tumblers operable in any sequence or simultaneously to enter a combination, a channel to protect the locking pin, and a locking pin with nested locking cylinders or a reduced or conical shaped nose to fit different sized latch plates or the area behind a gun trigger.

19 Claims, 5 Drawing Sheets

COMBINATION LOCK

BACKGROUND OF THE INVENTION

The present invention relates to a combination lock, and more particularly, to a combination lock which may be opened without viewing the lock and which includes a variable-sized shackle.

Combination locks are well known in the art. A combination lock typically includes a body, which includes tumblers, locking members and a combination dial. Extending from the body is an inverted U-shaped shackle with one leg slightly shorter than the other leg, which is engaged with the locking members to latch and release the shackle relative to the lock body. When released, the shackle moves upwardly out of the body to achieve relative reciprocal movement. The short end of the shackle will then pivot to open only after vertically clearing the lock body. One problem with these types of reciprocating shackle combination locks is the shackle is exposed and thus easy to cut using bolt cutters or other tools. Another problem with these types of locks is the combination dial must be viewed in order to enter the combination and open the lock. If the lock is in a position in which the dial is not visible or if it is dark, the lock is difficult to open.

Another type of lock well known in the art is the gun lock or gun trigger lock. The detachable gun lock typically includes a back plate with a post which extends through the trigger guard of the gun in front of the trigger, and a combination or key actuated bolt which cooperates with the post to secure the post between the trigger guard and the trigger. A problem with the dial combination gun lock is in an emergency it may take several attempts to correctly enter the combination and open the lock. If it is dark or if the gun owner requires corrective lenses to be able to see and is not wearing them, the dial may not be readily seen. This problem is especially difficult at night when the gun owner is awakened by the sound of an intruder. The gun owner may not want to turn on a light in order to read the combination dial. Another problem with gun trigger locks is the lock is often clamped to the trigger guard with pressure. If the friction between the lock and the trigger guard is overcome, the trigger may be pulled and the gun fired if loaded. With a key-actuated trigger lock, if the key is located, anyone may open the lock and use the gun. Conversely, if the key is lost or cannot be located in an emergency, the lock cannot be opened when necessary.

SUMMARY OF THE INVENTION

The present invention provides a combination lock which may be used in place of prior art shackle locks and gun locks. The combination lock includes indexed tumbler buttons to enter the combination without having to view the lock. A variable-sized locking pin is protected within the protective housing and occupies the space behind a trigger on a gun or the eye of a latch plate. The tumbler buttons may be activated separately or simultaneously in any sequence to operate the combination lock.

Other advantages of this invention will become apparent from the following description taken in connection with the accompanying drawings, wherein is set forth by way of illustration and example, a preferred embodiment of the present invention.

DETAILED DESCRIPTION

Figure 1:
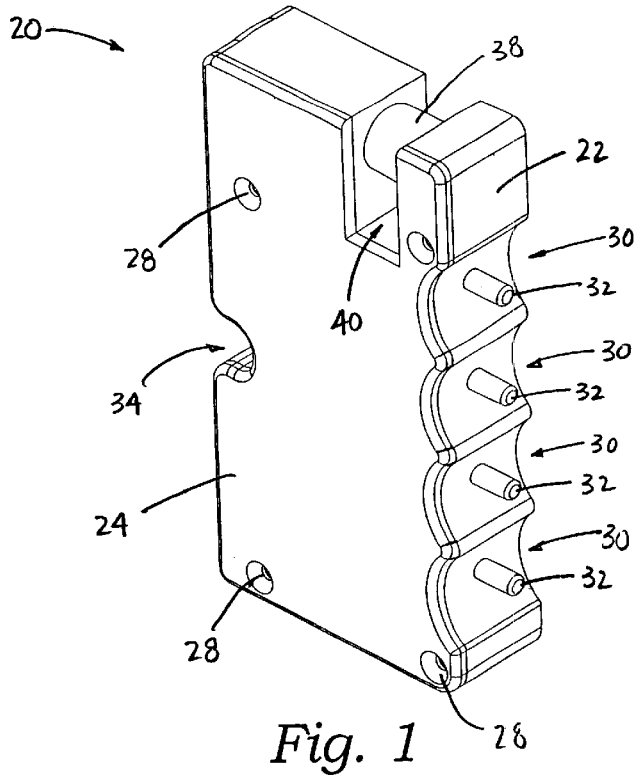
FIG. 1 is a perspective view of the combination lock of the present invention.
Figure 2:
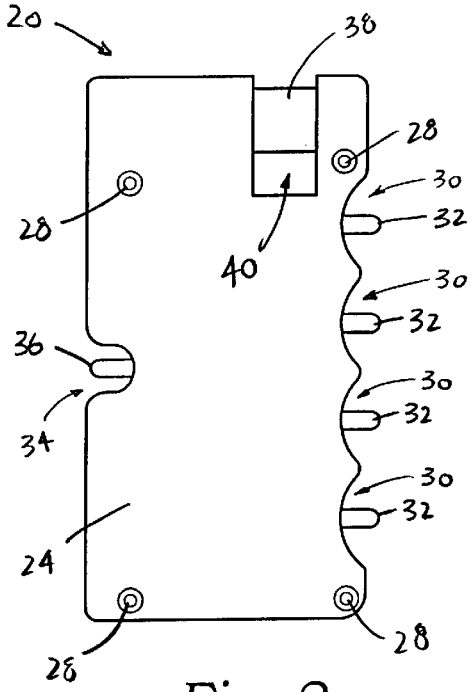
FIG. 2 is a front elevation view of the combination lock of the present invention in the locked position.
Figure 3:
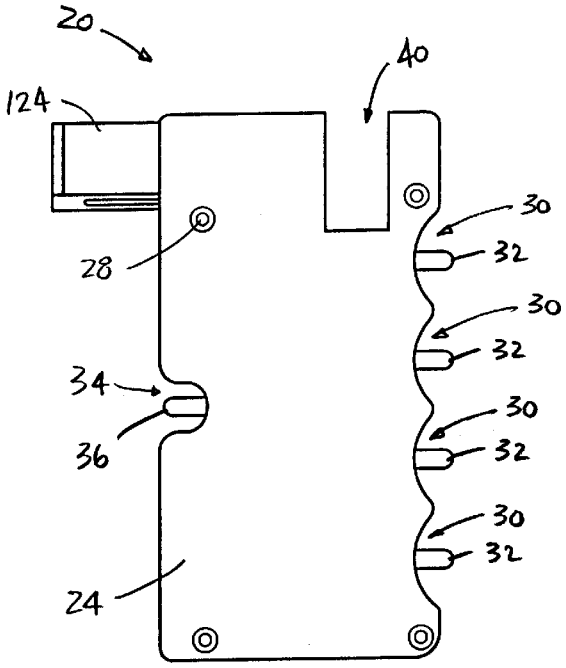
FIG. 3 is a front elevation view of the combination lock of the present invention in the unlocked position.
Figure 4:
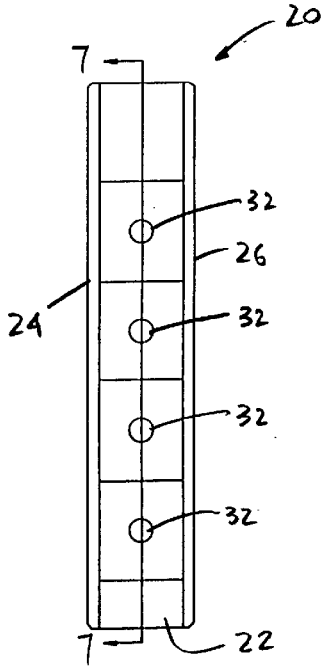
FIG. 4 is a side elevation view of the combination lock of the present invention.

Referring to FIGS. 1–4, an illustration of the combination lock of the present invention is generally indicated by reference numeral 20. Combination lock 20 includes a housing 22, with a front 24 cover and back cover 26. Covers 24 and 26 are each secured to the housing 22 by four fasteners 28. One side of housing 22 includes four indentions 30, which are shaped to accommodate the four fingers of a hand when gripping the combination lock 20 in either hand. Four tumbler buttons 32 extend from housing 22 and are centered in the indentions 30. Opposite indentions 30 is a reset indention 34 with a reset button 36 extending from housing 22 (FIGS. 2 and 3). A locking pin 38 extends across a channel 40 in housing 22 when in the locked position (FIGS. 1 and 2) and locking pin housing 124 extends from housing 22 when in the unlocked position (FIG. 3). Channel 40 is sized to accommodate the eye of a latch plate or the trigger guard of a gun, for example. Combination lock 20 may be used with either the left or right hand.

Figure 6:
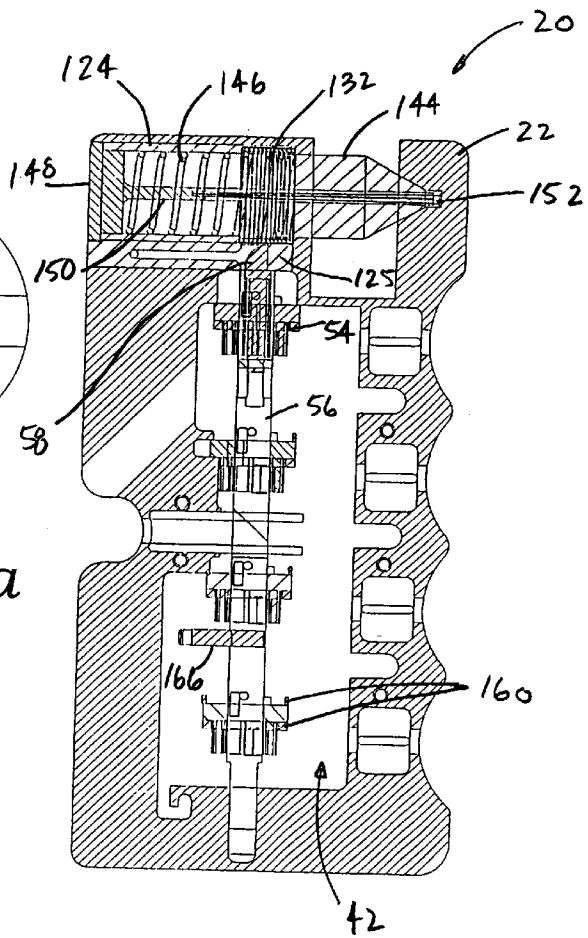
FIG. 6 is a front elevation view of the combination lock of FIG. 5.
Figure 5A:
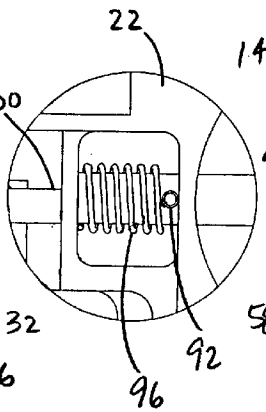
FIG. 5*a* is an enlarged view of a tumbler button structure of FIG. 5.
Figure 5:
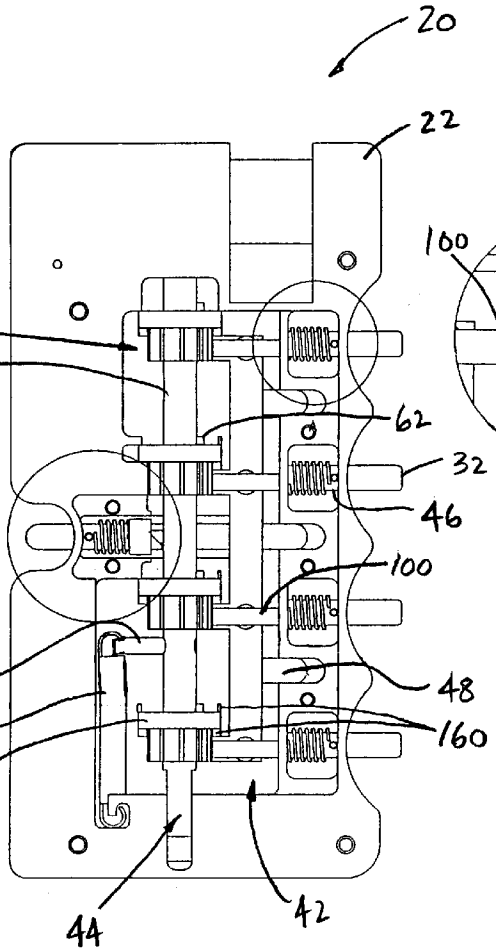
FIG. 5 is a perspective view of the combination lock of FIG. 1 with the front cover removed.
Figure 7:
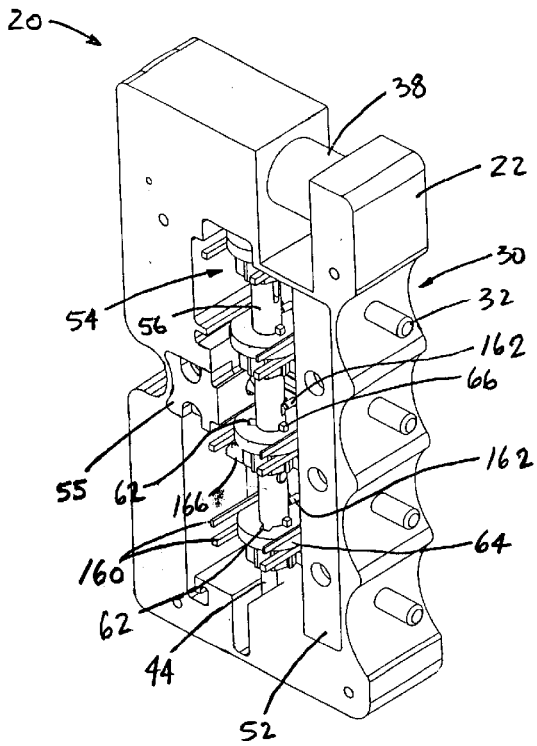
FIG. 7 is a sectional view of the combination lock of FIG. 4.
Figure 8:
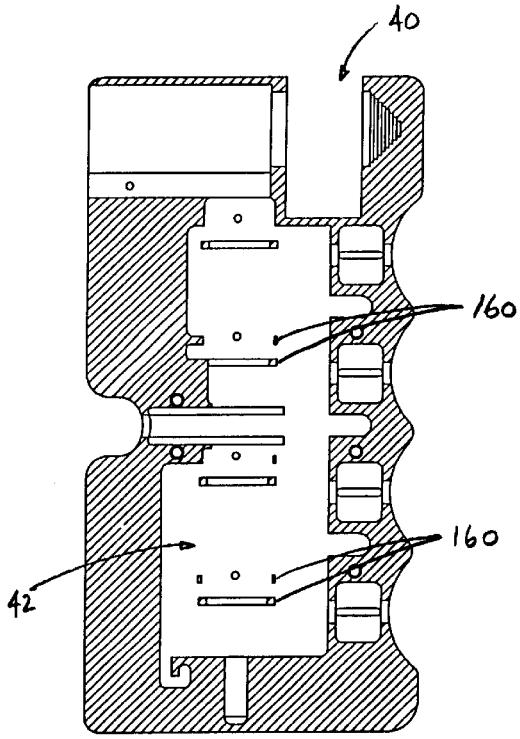
FIG. 8 is a sectional view of a housing with the components removed.
Figure 9:
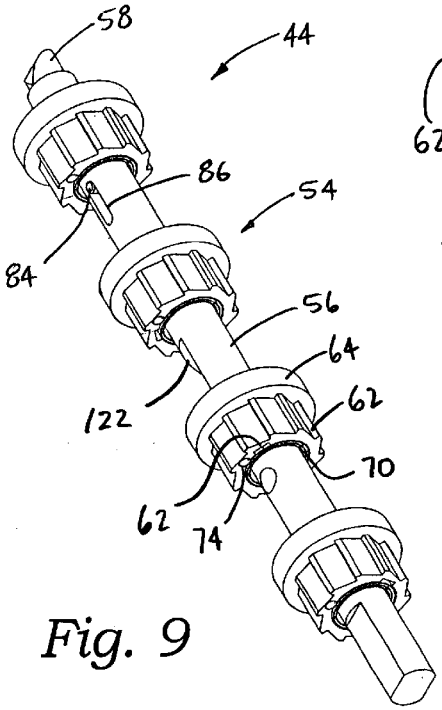
FIG. 9 is an enlarged perspective view of the tumbler shaft assembly.
Figure 10:
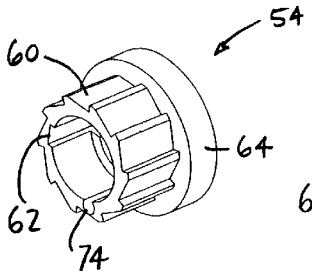
FIG. 10 is an enlarged front perspective view of a tumbler.
Figure 11:
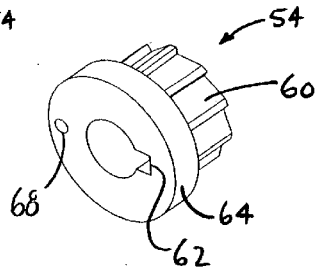
FIG. 11 is rear perspective view of the tumbler of FIG. 8.
Figure 12:
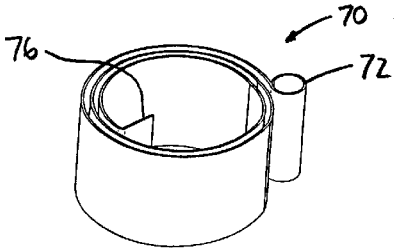
FIG. 12 is an enlarged perspective view of a reset spring.
Figure 13:
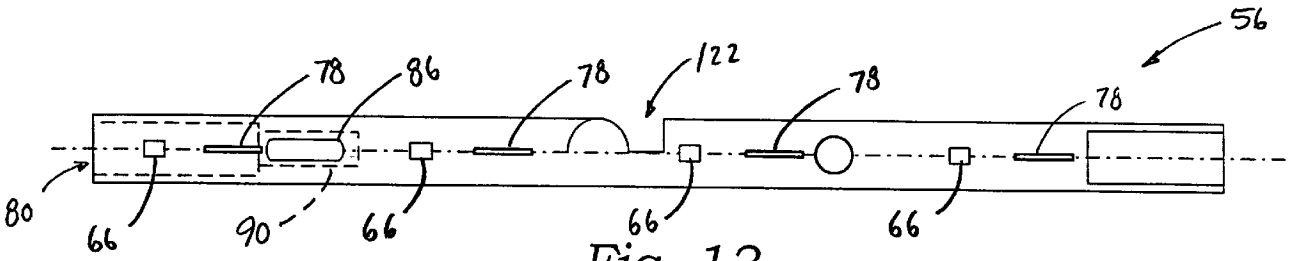
FIG. 13 is an enlarged side view of the tumbler shaft.
Figure 14:
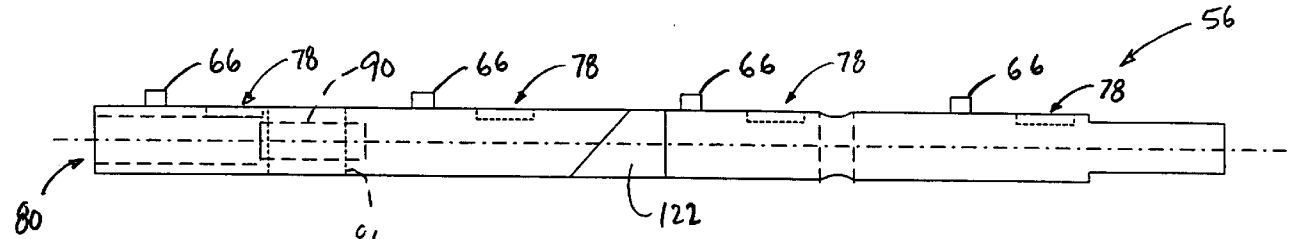
FIG. 14 is a side view of the tumbler shaft of FIG. 13 rotated ninety degrees.

Referring to FIGS. 5 and 6, housing 22 includes a cavity 42 in which the components of lock 20 are contained. Included in housing 22 is a tumbler shaft assembly 44, a tumbler button assembly 46, a tumbler lock and reset bar assembly 48, and a locking pin assembly 50. The tumbler button assembly 46 drives tumbler shaft assembly 44 through operation of tumbler buttons 32, and is retained in housing 22 by tumbler button retaining cover 52 (FIG. 7). Tumbler lock and reset bar assembly 48 holds each tumbler 54 in an indexed position determined by the number of tumbler button 32 presses. When reset button 36 is depressed, tumbler lock and reset assembly 48 releases tumblers 54 to return to the reset position. Tumbler lock and rest bar assembly 48 is held in housing 22 by tumbler lock and reset bar assembly retaining cover 55 (FIG. 7).

Referring to FIGS. 9–15, the tumbler shaft assembly 44 includes a shaft 56, four spaced-apart tumblers 54, and a retaining latch 58. Tumbler 54 (shown enlarged for detail in FIGS. 10 and 11) includes an index gear 60, which has nine teeth corresponding to nine rotational positions. An index notch or keyway 62 on the inner circumference of index gear 60 extends coaxially with the axis of rotation of tumbler 54, through tumbler base 64 is shaped to allow key tabs 66 (FIGS. 13 and 14) to freely pass through tumbler 54 when the correct combination is entered or when the lock is set. A zero-position aperture 68 (shown with zero position pin removed) marks the zero or reset position of tumbler 54. When the combination lock is reset, all tumblers rotate about shaft 56 to return to this position.

Reset spring 70 (shown enlarged for detail in FIG. 12) is formed from a coiled piece of spring steel with a cylindrical first end 72 adapted to engage a semi-circular notch 74 in index gear 60, which extends coaxially with the axis of rotation of tumbler 54. The other end 76 of spring 70 is bent at a generally right angle and radially inwardly to the center of spring 70. The bent end 76 of spring 70 is adapted to engage slots 78 spaced along tumbler shaft 56 (see FIGS. 13 and 14). When reset spring 70 is installed in a tumbler 54 and the tumbler 54 is placed on the tumbler shaft 56, the tumbler 54 may rotate from a starting or zero position around shaft 54 and return to the starting position by the reset spring 70 which is anchored to the shaft by the bent end 76 inserted into slots 78 and attached to the tumbler 54 by the cylindrical end 72 inserted into notch 74. The slots 78 are long enough to allow tumbler shaft 56 to slide to the released position.

Tumbler shaft 56 (shown enlarged for detail in FIGS. 13 and 14) includes an aperture 80 at one end adapted to receive retaining latch or latch dog 58. A retaining pin 84 passes through a pair of radially aligned slots 86 in shaft 56 through a hole 106 in the end of retaining latch 58 to secure retaining latch 58 within aperture 80. The retaining pin 84 and slots 86 allow retaining latch 58 to reciprocate within aperture 80. A spring (not shown) at the base 90 of aperture 80 biases retaining latch 58 outwardly from the end of shaft 56.

Retaining latch 58 (shown enlarged and removed from shaft 56 in FIG. 15) includes a latching head 102 and a latch post 104. Aperture 106 through the end of post 104 opposite head 102 receives pin 84 to slidably secure retaining latch 58 within aperture 80 of shaft 56.

Figure 16:
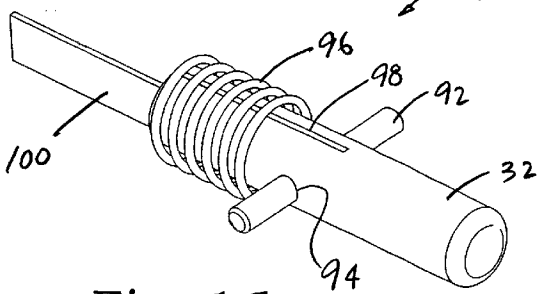
FIG. 16 is an enlarged perspective view of the tumbler button assembly.
Figure 15:
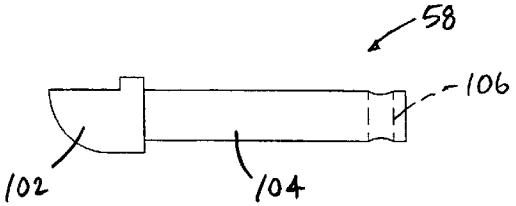
FIG. 15 is an enlarged side elevation view of the retaining latch.

Tumbler button assembly 46 (shown enlarged and removed from housing 22 in FIG. 16) includes a cylindrical tumbler button 32, which extends from housing 22. Button 32 is held in housing 22 with a retaining pin 92 which passes through an aperture 94 in tumbler button 32. Tumbler button spring 96 biases tumbler button 32 outwardly from housing 22. When a button 32 is depressed, spring 96 is compressed and then returns the button to the starting position. Button 32 includes a slotted end 98 to receive a flexible blade 100 which engages the index gear 60 of tumbler 54 to incrementally rotate tumbler 54 around shaft 56. Each time a button 32 is depressed, the blade 100 engages the index gear 60 to rotate tumbler 54 about tumbler shaft 56 one notch of the gear 60.

Figure 17:
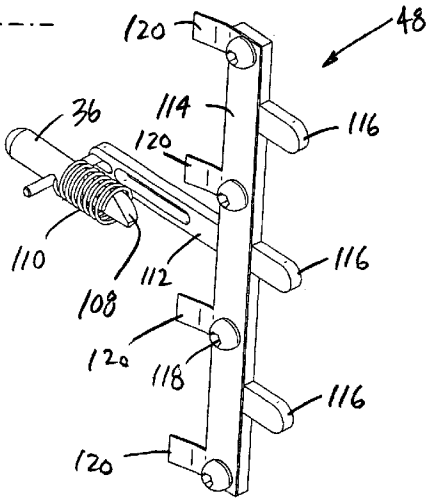
FIG. 17 is an enlarged perspective view of the tumbler lock and reset assembly.

Tumbler lock and reset bar assembly 48 (shown enlarged an removed from housing 22 in FIG. 17) includes reset button 36 with a chamfered end 108, reset spring 110, reset bar 112, and tumbler lock bar 114. Reset bar 112 is slidably mounted in housing 22 and moves between a tumbler lock position and a reset position. Reset bar 112 includes three fingers or guides 116 which help the reset bar 112 maintain its alignment with respect to the tumblers 54 when moving between the lock and reset positions. Tumbler lock bar 114 is secured to reset bar 112 using rivets, machine screws, or other fasteners 118. Tumbler lock bar 114 includes four lock fingers 120. When the tumbler lock and reset bar assembly 48 is in the lock position, the four lock fingers 120 engage the index gears 60 of tumblers 54 to prevent the tumblers 54 from rotating in the clockwise direction. When reset button 36 is depressed, which moves the tumbler lock and reset bar assembly 48 to the reset position, the four lock fingers 120 of tumbler lock bar 114 are moved away from the index gears 60 of tumblers 54 which allow the reset springs 70 to return the tumblers 54 to the starting position. The chamfered end 108 of reset button 36 is adapted to engage a chamfered or angled notch 122 in tumbler shaft 56.

Figure 18:
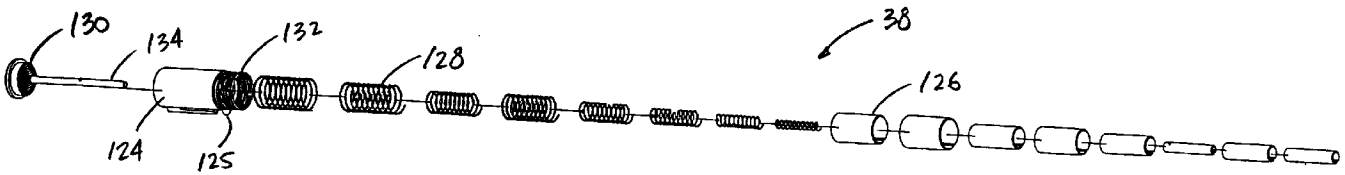
FIG. 18 is an exploded view of a nesting locking pin.

Referring to FIG. 18, a nesting locking pin 38 is illustrated in an exploded view. Nesting locking pin 38 includes a housing 124, a plurality of expansion cylinders 126 which are biased outwardly from housing 124 by a plurality of springs 128 against button 130. A retraction spring 132 biases the nesting locking pin housing 124 outwardly from the combination lock housing 22 (FIG. 3) to retract locking pin 38 from channel 40 when the combination is correctly entered and the lock released. Lock button 120 includes an expansion locking pin 134 which extends across channel 40 with cylinders 126. The nesting locking pin 38 completely fills the hole of the unit being locked, up to the outer dimension of the nesting locking pin 38. Once the lock is engaged, the nesting locking pin 38 becomes a solid unit with the unit being locked.

Figure 19:
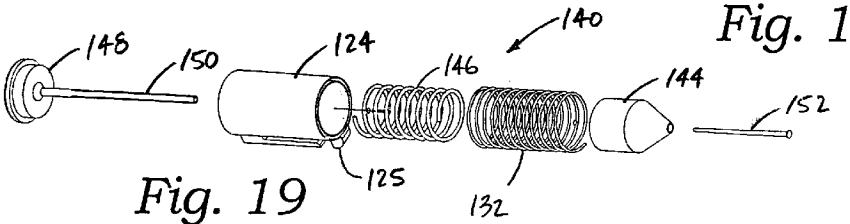
FIG. 19 is an exploded view of a tapered locking pin.

Referring to FIG. 19, a reduced locking pin 140 is illustrated in an enlarged and exploded view. Reduced locking pin 140 includes a housing 124, a cone-shaped tip 144 which is outwardly biased from housing 124 by spring 146 against button 148. Button 148 includes a hollow expansion push pin 150 and a taper pin 152 which extends through tip 144 and engages hallow expansion push pin 150. A retraction spring 132 biases the reduced locking pin housing 124 outwardly from the combination lock housing 22 to retract locking pin 140 from channel 40 when the combination is correctly entered (see FIG. 3).

The cone 144 is pushed through the opening 40 of the lock housing 22 and through the opening of the unit being locked until cone 144 engages the outmost perimeter of the hole in the unit being locked. Shaft 150 of button 148 keeps extending through cone 144 until expansion pin 152 is engaged by the opposite side of channel 40. At this point expansion 152 is fully extended into shaft 150 solidly engaging cone 144 into a locked position. Expansion pin 152 is locked and held into place by expansion and friction. Cone 144 is locked in position by lock tab 125 which is engaged with retaining latch 58. If cone 144 pushes all the way through the unit being locked, cone 144 engages recess 39 in housing 22. Once disengaged, springs 146 and 132 push locking pin 38 out of lock channel 40.

Referring to FIGS. 5–8, internal views and cross sectional views of the combination lock 20 and housing 22 are shown.

Tumbler shaft assembly 44 is positioned within cavity 42 of housing 44 between spaced-apart upper and lower guides 160, which receive each tumbler base 64 therebetween. Tumblers 54 rotate counter clockwise around shaft 56 in response to a depression of one of the tumbler buttons 32. The motion of tumbler button 32 is transferred to the tumbler gear 60 by blade 100. Each of the tumblers 54 may independently rotate about shaft 56 driven by tumbler button assemblies 46 until the keyways 62 of all tumblers are aligned with shaft keys 66 or zero position pin (not shown) encounters stop pins 162. If all the keyways 62 of all tumblers 54 are aligned with shaft keys 66, the shaft 56 is pulled through each of the tumblers 54 by shaft release spring 164 attached between housing 22 and pull-down pin 166 secured to shaft 56. When the shaft 56 is pulled-down, shaft latch 58 releases locking pin 38 (or 140) to unlock combination lock 20.

To reset lock 20, reset button 36 is depressed. Chamfered end 108 of reset button 36 engages notch 122 in shaft 56 to lift shaft 56 to the reset position. When keys 66 clear the tumbler bases 64, the tumblers 54 rotate clockwise by spring 70 to the reset or zero position. Release latch 58 is now in position to engage locking pin housing latch 125.

Figure 20:
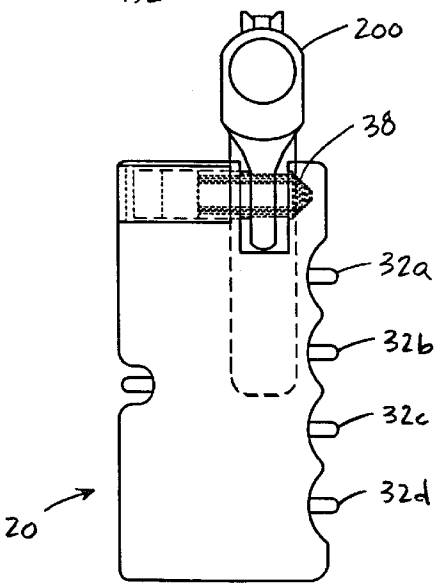
FIG. 20 is a front elevation view of the combination lock of the present invention engaged with a revolver.
Figure 21:
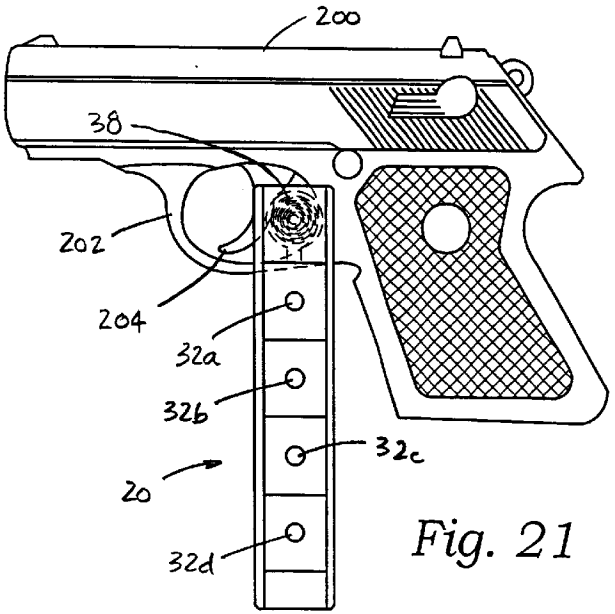
FIG. 21 is a side elevation view of the combination lock of the present invention engaged with a revolver.

Referring to FIGS. 20 and 21, combination lock 20 is shown in use as a gun trigger lock attached to gun 200. Trigger guard 202 of gun 200 is inserted into channel 40 of combination lock 20. Nested locking pin 38 is extended across channel 40 behind trigger 204. The entire space behind trigger 204 is filled by locking pin 38. To open combination lock 20, tumbler buttons 32 may be pushed in any order or simultaneously to the preset combination.

For example, if the preset combination is 2635, the first tumbler button 32*a* may be pushed twice, followed by the second tumbler button 32*b* being pushed six times, followed by the third button 32*c* being pushed three times, and finally the last tumbler button 32*d* being pushed five times. Another way the combination lock 20 may be opened is by activating all buttons twice, buttons 32*b*, 32*c*, and 32*d* a third time, buttons 32*b* and 32*d* fourth and fifth times, and button 32*b* a sixth time. In this manner combination lock 20 may be opened very quickly without looking at the lock. It should be appreciated that by eliminating the need to visually look at the combination lock 20 in order to unlock it, combination lock 20 may be effectively used in the dark or in low lighting environments, or in positions where the lock may be partially or totally obscured from direct vision.

When used to lock a gun, the locking pin will fill the space between the trigger 204 and trigger guard 202 of most guns. In the case of a semiautomatic gun, the lock 20 will fit in front of the trigger with the trigger pulled pressing the trigger all the way back into the gun housing rendering the gun unable to be fired.

It should be understood that while a certain form of this invention has been illustrated and described, it is not limited thereto except insofar as such limitations are included in the following claims.

Having thus described the invention, what is claimed as new and desired to be secured by Letters Patent is:

1. A combination lock comprising:

a housing having a locking channel, a locking pin in said housing movable between an unlocked position and a locked position extending into said channel of said housing, said locking pin comprising a plurality of spring biased nested cylinders for extending into said channel, an elongated tumbler shaft having a latch dog for engaging said locking pin in said locked position, at least two radially extending keys, and movable longitudinally between a set position engaging said locking pin and a released position disengaging said locking pin, at least two rotatable tumblers on said tumbler shaft, each of said tumblers having a plurality of index positions and a keyway clearing said keys when the tumbler shaft is in said released position, and at least two tumbler buttons extending from said housing for actuating respective tumblers by rotating an actuated tumbler one index position at a time to a predetermined index position, whereby upon rotation of the tumblers to their respective predetermined index positions, the tumbler shaft is longitudinally movable to release the locking pin.

2. The combination lock as claimed in claim 1 further comprising a means to rotate said tumblers from an index position to a reset position.

3. The combination lock as claimed in claim 2 wherein said means to rotate includes means to move said tumbler shaft from said released position to said set position.

4. The combination lock as claimed in claim 1 wherein said locking pin is spring actuated from said locked position to said unlocked position.

5. The combination lock as claimed in claim 1 wherein said tumbler shaft is spring actuated from said set position to said released position.

6. A combination trigger lock for a gun comprising:

a housing having a locking channel adapted to receive the trigger guard of said gun, a locking pin in said housing having a plurality of spring biased nested cylinders for extending into said channel and movable between an unlocked position and a locked position extending into said channel of said housing and occupying a space behind the trigger, between the trigger and the trigger guard of said gun, an elongated tumbler shaft having a latch dog for engaging said locking pin in said locked position, at least two radially extending keys, and movable longitudinally between a set position engaging said locking pin and a released position disengaging said locking pin, at least two rotatable tumblers on said tumbler shaft, each of said tumblers having a plurality of index positions and a keyway clearing said keys when the tumbler shaft is in said released position, and at least two tumbler buttons extending from said housing for actuating respective tumblers by rotating an actuated tumbler one index position at a time to a predetermined index position, whereby upon rotation of the tumblers to their respective predetermined index positions, the tumbler shaft is longitudinally movable to release the locking pin.

7. The combination lock as claimed in claim 6 wherein said locking pin is spring actuated from said locked position to said unlocked position.

8. The combination lock as claimed in claim 6 wherein said tumbler shaft is spring actuated from said set position to said released position.

9. The combination lock as claimed in claim 6 further comprising a means to rotate said tumblers from an index position to a reset position.

10. The combination lock as claimed in claim 9 wherein said means to rotate includes means to move said tumbler shaft from said released position to said set position.

11. A combination lock comprising:

a housing having a locking channel, said locking channel having a first side and a second side, said second side of said locking channel having a recessed cavity, a locking pin in said housing movable between an unlocked position and a locked position extending from said first side of said locking channel across said locking channel into said recessed cavity of said second side of said locking channel, an elongated tumbler shaft having a spring-biased retaining latch for engaging said locking pin in said locked position, a plurality of radially extending keys, and movable longitudinally between a set position engaging said locking pin and a released position disengaging said locking pin, a plurality of rotatable tumblers on said tumbler shaft, each of said tumblers having a plurality of index positions and a keyway for clearing said keys when said tumbler shaft is in said released position, and a plurality of tumbler buttons extending from said housing for actuating respective tumblers by rotating an actuated tumbler one index position at a time to a predetermined index position, whereby upon rotation of the tumblers to their respective predetermined index positions, the tumbler shaft is longitudinally movable to release the locking pin.

12. The combination lock as claimed in claim 11 wherein said locking pin comprises a plurality of spring biased nested cylinders for extending into said channel.

13. The combination lock as claimed in claim 11 wherein said locking pin conical nose for extending into said channel.

14. The combination lock as claimed in claim 11 wherein said locking pin is spring actuated from said locked position to said unlocked position.

15. The combination lock as claimed in claim 11 wherein said tumbler shaft is spring actuated from said set position to said released position.

16. The combination lock as claimed in claim 11 further comprising a means to rotate said tumblers from an index position to a reset position.

17. The combination lock as claimed in claim 16 wherein said means to rotate includes means to move said tumbler shaft from said released position to said set position.

18. In combination with a lock having a housing and a locking channel, said locking channel having a first side and a second side, said second side of said locking channel having a recessed cavity, a locking pin comprising:

a housing, a plurality of nested expansion cylinders slidably secured within said housing, said expansion cylinders movable between a retracted position within said housing and an extended position extending from said housing, a plurality of expansion springs for biasing respective expansion cylinders outwardly from said housing, a push button for moving said expansion cylinders from said retracted position to said extended position, and means to lock said expansion cylinders in said extended position, whereby in said retracted position said expansion cylinders are retained within said housing, whereby in said extended position said expansion cylinders are extended outwardly from said housing from said first side of said channel and engage the recess in the second side of said channel.

19. In combination with a lock having a housing and a locking channel, said locking channel having a first side and a second side, said second side of said locking channel having a recessed cavity, a locking pin comprising:

a housing, a locking cylinder slidably secured within said housing, said locking cylinder having a cone-shaped nose, and movable between a retracted position within said housing and an extended position extending from said housing, an expansion springs for biasing said locking cylinder outwardly from said housing, a push button for moving said locking cylinder from said retracted position to said extended position, and means to lock said locking cylinder in said extended position, whereby in said retracted position said expansion cylinder is retained within said housing, whereby in said extended position said locking cylinder is extended outwardly from said housing from said first side of said channel and engages the recess in the second side of said channel.

* * * * *

UNITED STATES PATENT AND TRADEMARK OFFICE

CERTIFICATE OF CORRECTION

PATENT NO. : 6,755,059 B1
DATED : June 29, 2004
INVENTOR(S) : Kent J. Nall

It is certified that error appears in the above-identified patent and that said Letters Patent is hereby corrected as shown below:

Column 2,
Line 63, after "FIGS. 5" insert -- , 5a, 5b --

Figure 5B:
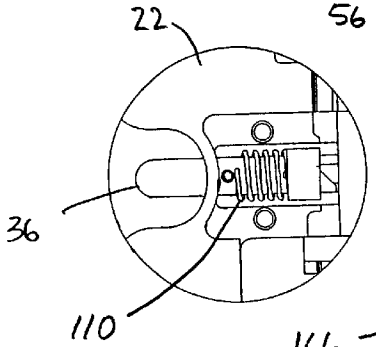
FIG. 5*b* is an enlarged view of a reset button structure of FIG. 5.

Column 4,
Line 3, after "gear 60" insert -- (See FIGS. 5 and 5a) --
Line 25, after "shaft 56" insert -- (See FIGS. 5 and 5b) --

Column 7,
Line 28, after "locking pin" insert -- includes --

Signed and Sealed this

Seventh Day of September, 2004

JON W. DUDAS
*Director of the United States Patent and Trademark Office*